US005240381A

United States Patent [19]

Nagai et al.

[11] Patent Number: 5,240,381

[45] Date of Patent: Aug. 31, 1993

[54] EXHAUST APPARATUS AND VACUUM PUMPING UNIT INCLUDING THE EXHAUST APPARATUS

[75] Inventors: Kazutoshi Nagai, Tokyo; Tohru Satake; Hideaki Hayashi, both of Kanagawa; Takanari Yasui, Miyagi, all of Japan

[73] Assignee: Ebara Corporation, Tokyo, Japan

[21] Appl. No.: 833,853

[22] Filed: Feb. 12, 1992

Related U.S. Application Data

[63] Continuation-in-part of Ser. No. 739,361, Aug. 2, 1991, abandoned.

[30] Foreign Application Priority Data

| | | | |
|---|---|---|---|
| Aug. 3, 1990 | [JP] | Japan | 2-205224 |
| Feb. 12, 1991 | [JP] | Japan | 3-38847 |
| Feb. 12, 1991 | [JP] | Japan | 3-38848 |

[51] Int. Cl.[5] ..... H01J 41/14; H01J 41/18

[52] U.S. Cl. ..... 417/48; 417/49

[58] Field of Search ..... 417/49, 48

[56] References Cited

U.S. PATENT DOCUMENTS

| | | | |
|---|---|---|---|
| 2,460,175 | 1/1949 | Hergenrother | 417/49 |
| 2,578,009 | 12/1951 | Linder . | |
| 2,636,664 | 4/1953 | Hertzler | 417/49 |
| 3,107,044 | 10/1963 | Brubaker et al. | 417/49 |
| 3,249,291 | 5/1966 | Ackley | 417/49 |

FOREIGN PATENT DOCUMENTS

| | | |
|---|---|---|
| 0469631A2 | 2/1992 | European Pat. Off. . |
| 596017 | 4/1934 | Fed. Rep. of Germany . |
| 1915367 | 3/1968 | Fed. Rep. of Germany . |
| 968943 | 12/1950 | France . |
| 3-163733 | 7/1991 | Japan . |
| 684710 | 12/1952 | United Kingdom . |
| 762365 | 11/1986 | United Kingdom . |

OTHER PUBLICATIONS

Journal of Applied Physics, vol. 32, No. 3, pp. 424–434, Mar. 1961.

*Primary Examiner*—Richard A. Bertsch
*Assistant Examiner*—David W. Scheuermann
*Attorney, Agent, or Firm*—Nikaido, Marmelstein, Murray & Oram

[57] ABSTRACT

An exhaust apparatus and a high vacuum pumping unit including such high vacuum device and an auxiliary vacuum pump are disclosed, wherein a high vacuum is achieved in a vacuum vessel such that the gas molecules within the vacuum vessel are ionized and accelerated to be exhausted and, further, in the high vacuum pumping unit, those gas molecules diffused back or desorbed from the vacuum pump are ionized and accelerated to be returned to the vacuum pump.

26 Claims, 7 Drawing Sheets

EXHAUST APPARATUS AND VACUUM PUMPING UNIT INCLUDING THE EXHAUST APPARATUS

This is a continuation-in-part application of U.S. Ser. No. 739,361, filed on Aug. 2, 1991, now abandoned.

BACKGROUND OF THE INVENTION

1. Field of the Invention

The present invention relates to an exhaust apparatus and a vacuum pumping unit including the exhaust apparatus, which are specifically adapted for discharging a gas in a vacuum vessel to produce an ultrahigh vacuum in the semiconductor process or the like.

2. Prior Art

FIG. 12 conceptionally illustrates a prior art vacuum equipment including the high vacuum pump, wherein a vacuum chamber 1 is connected to a vacuum pump 2 through an exhaust pipe 3. The vacuum pump 2, which comprises, for example, a turbo molecular pump, an oil diffusion pump, an ion pump and the like and, exhausts only the gas molecules which fly into the exhaust pipe 3 from the vacuum chamber 1.

However, in the above-constructed vacuum equipment, when a turbo molecular pump is used to exhaust a gas with a low compression ratio such as hydrogen, helium or the like, gas molecules may diffuse back to a high vacuum side i.e. to the vacuum chamber 1 and, thus causes a decrease in vacuum level.

In the case of an oil diffusion pump, the gas molecules, which were once exhausted by the pump, may flow back into the vacuum chamber and further, the vapor of pumping oil heated also diffuses back. Thus vacuum level decreases.

In the case of the ion pump, gas molecules absorbed into a titanium wall of the pump are desorbed and flow back into the vacuum chamber, thus reducing a vacuum level.

In the prior art, no effective means were available against the back diffusion of gas molecules with a low compression ratio or desorbed gas molecules from the vacuum pump. Nevertheless, oil vapor of the oil diffusion pump may be prevented only by providing a cold trap with liquid nitrogen, however, complete prevention for any counterflow has been substantially difficult.

SUMMARY OF THE INVENTION

The present invention has been carried out in view of the circumstances, and its object is to provide an exhaust apparatus capable of obtaining a high degree of vacuum by exhausting gas molecules in the vacuum chamber through ionization and acceleration of the gas molecules.

Then, another object of the present invention is to provide a vacuum pumping unit for an exhaust apparatus which is combined with an auxiliary pump set on a back pressure side for the pumping unit. The vacuum pumping unit is capable of producing a high degree of vacuum by ionization and acceleration of the gas molecules in a vacuum chamber toward the auxiliary pump, and also by ionization and acceleration of gas molecules which flow back from the auxiliary pump toward the auxiliary pump.

To achieve the above described objects, an exhaust apparatus according to a first aspect of the present invention comprises: a vessel; means provided in said vessel for ionizing gases in said vessel; and means provided in said vessel for accelerating said ionized gases to discharge said gases out of said vessel.

An exhaust apparatus according to a second aspect of the present invention comprises: a cathode; an electron accelerating grid surrounding the cathode; an outer electrode surrounding the electron accelerating grid; an ion accelerating grid intersecting the axis of the outer electrode and installed apart from the outer electrode; a vessel for accommodating the grids and the electrodes; a magnet disposed outside of the vessel for generating a magnetic field almost parallel to the axis of said outer electrode; a high voltage power supply for applying a high voltage between said cathode and said electron accelerating grid; a DC power supply for applying a voltage between said electron accelerating grid and said outer electrode; and a DC power supply for applying a voltage between said outer electrode and said ion accelerating grid so as to get said outer electrode positive.

An exhaust apparatus according to a third aspect of the present invention comprises: a cold cathode; a cylindrical electron accelerating grid surrounding the cold cathode; an outer electrode surrounding the accelerating grid; an ion accelerating grid intersecting an axis of the outer electrode and installed apart from the outer electrode; a vessel for accommodating the grids and the electrodes; a magnet disposed outside of the vessel for generating a magnetic field almost parallel to the axis of said outer electrode; a high voltage power supply for applying a high voltage between said cold cathode and said electron accelerating grid; a DC power supply for applying a voltage between said electron accelerating grid and said outer electrode; and a DC power supply for applying a voltage between said outer electrode and said ion accelerating grid so as to get said outer electrode positive.

An exhaust apparatus according to a fourth aspect of the present invention comprises: a cold cathode; an outer electrode surrounding the cold cathode; an ion accelerating grid intersecting an axis of the outer electrode and installed apart from the outer electrode; a vessel for accommodating the grid and the electrodes; a magnet disposed outside of the vessel for generating a magnetic field almost parallel to the axis of said outer electrode; a high voltage power supply for applying a high voltage between said cold cathode and said outer electrode; and a DC power supply for applying a voltage between said outer electrode and said ion accelerating grid so as to get said outer electrode positive.

An exhaust apparatus according to a fifth aspect of the present invention comprises: an outer electrode, a grid electrode intersecting an axis of the outer electrode and installed apart from the outer electrode; a vessel for accommodating said outer electrode and said grid electrode; a magnet provided outside of the vessel for generating a magnetic field almost parallel to the axis of said outer electrode; and a DC power supply for applying a high voltage between said outer electrode and said grid electrode so as to get said grid electrode negative.

An exhaust apparatus according to a sixth aspect of the present invention comprises: a first grid electrode; a second grid electrode installed opposite to the first grid electrode; a vessel for accommodating the first and second grid electrodes; a magnet provided outside of the vessel for applying a magnetic field intersecting said first and second grid electrodes; and a DC power supply for applying a high voltage between said first and second grid electrodes so as to get the second grid electrode negative.

An exhaust apparatus according to a seventh aspect of the present invention comprises: a first grid electrode; a second grid electrode installed opposite to the first grid electrode; a vessel for accommodating the two electrodes; coils or electrodes disposed outside of the vessel and connected to a high frequency power supply; and a DC power supply for applying a voltage between said first and second grid electrodes so as to get the second grid electrode negative.

An exhaust apparatus according to an eighth aspect of the present invention comprises a thermal electron emission source, an electron accelerating grid surrounding the thermal electron emission source, an outer electrode surrounding the electron accelerating grid, an ion accelerating grid intersecting an axis of the outer electrode and installed apart from the outer electrode, a vessel for containing said thermal electron emission source, said electron accelerating grid, said outer electrode, and said ion accelerating grid therein, a magnet disposed outside of the vessel to generate a magnetic field almost parallel to the axis of said outer electrode, a power supply for heating said thermal electron emission source, a first DC power supply for applying a voltage between said electron accelerating grid, said outer electrode and said thermal electron emission source, a second DC power supply for applying a voltage between said outer electrode and said ion accelerating grid so as to get said outer electrode positive.

An exhaust apparatus according to a ninth aspect of the present invention comprises a thermal electron emission source, an outer electrode surrounding the thermal electron emission source, an ion accelerating grid intersecting an axis of the outer electrode and installed apart from the outer electrode, a vessel for containing said thermal electron emission source, said outer electrode, and said ion accelerating grid therein, a magnet disposed outside of the vessel for generating a magnetic field almost parallel with the axis of said outer electrode, a power supply for heating said thermal electron emission source, a first DC power supply for applying a voltage between said outer electrode and said thermal electron emission source, a second DC power supply for applying a voltage between said outer electrode and said ion accelerating grid so as to get said outer electrode positive.

A vacuum pumping unit of the present invention is constituted by combining an optionally selected vacuum pump with the high vacuum device according to one of the aspects of the present invention described above.

With an exhaust apparatus of the present invention, a high vacuum is achieved since the gas molecules within the vacuum vessel are ionized and accelerated. With a vacuum pumping unit of the present invention, the gas molecules diffused back or desorbed from the vacuum pump may be ionized and accelerated to be returned to the vacuum pump, and at the same time the gas molecules in the vacuum vessel may be ionized and accelerated to be actively fed into the vacuum pump. Thus the discharge efficiency should be improved to achieve a high degree of vacuum in the vacuum vessel.

The above and other objects, features and advantages of the present invention will become more apparent from the following description when taken in conjunction with the drawings in which preferred embodiments of the present invention are shown by way of illustrative examples.

DETAILED DESCRIPTION OF THE PREFERRED EMBODIMENTS

High vacuum devices according to the present invention and vacuum pumping unit including the high vacuum devices will now be described with reference to FIG. 1 through FIG. 11.

Figure 1:
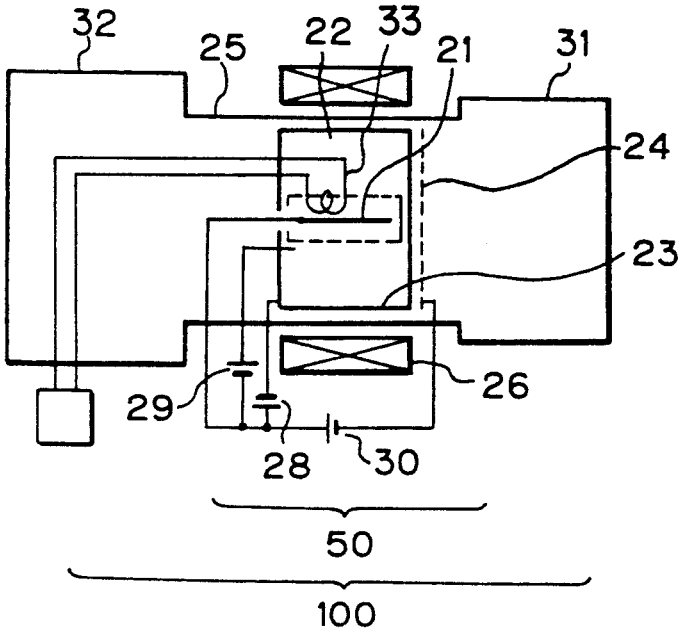
FIG. 1 is a view showing a first embodiment of the high vacuum device and the vacuum pumping unit including the high vacuum device according to the present invention.

FIG. 1 shows a first embodiment of the present invention in which numeral 50 denotes an exhaust apparatus of the present invention and numeral 100 denotes a vacuum pumping unit also of the present invention including the high vacuum device 50. Said vacuum pumping unit 100 is constituted by combining the high vacuum device 50 and a vacuum pump 31 provided on the back pressure side of the high vacuum device 50. The vacuum pump 31 may be a turbo-molecular pump, an oil pump or an ion pump.

Said high vacuum device 50 includes a vessel 25 for connecting the vacuum pump 31 and a vacuum vessel 32 to be evacuated. A rod-like cold cathode 21 is disposed at the center of the vessel 25, and an electron accelerating grid 22 is installed so as to surround the cold cathode 21. Further, a cylindrical electrode 23 forming an outer electrode is installed so as to surround the electron accelerating grid 22. An ion accelerating flat grid 24 is disposed so as to intersect the axis of the cylindrical electrode 23 and is installed apart from the cylindrical electrode 23.

On the other hand, an electromagnet 26 is disposed outside of the vessel 25 so as to produce a DC magnetic field almost parallel to the axis of the cylindrical electrode 23. Further, three DC power supplies 28, 29, 30 are provided outside of the vessel 25 so that the output of each of the DC power supplies are applied to each components 21, 22, 23, 24 through vacuum tight terminals provided at a portion of the vessel 25. The DC high voltage power supply 29 applies a high DC voltage between the cold cathode 21 and the electron accelerating grid 22. The ion accelerating DC power supply 30 applies a voltage between the cylindrical electrode 23 and the ion accelerating grid 24 so as to get the ion accelerating grid 24 negative. Further, the DC power supply 28 applies a voltage between the electron accelerating grid 22 and the cylindrical electrode 23 so as to get the cylindrical electrode 23 negative, and thereby the electrons are decelerated in the space.

The DC high voltage power supply 29 generates a discharge in gases between the cold cathode 21 and the electron accelerating grid 22. Electrons generated in the discharge are accelerated toward the electron accelerating grid 22 and obtain sufficient energy to pass the electron accelerating grid 22. Since a magnetic field perpendicular to the direction of electron's movement is applied between the electron accelerating grid 22 and the cylindrical electrode 23, the electrons are caused to move toward the cylindrical electrode 23 while moving in a circular path in the plane perpendicular to the axis of the cylindrical electrode 23. Under the circular movement of the electrons, the electrons' path toward the cylindrical electrode 23 is greatly lengthened, whereby they collide with a lot of gas molecules and a large amount of ions are generated. The generated ions are accelerated toward the ion accelerating grid 24 and pass through the grid 24 to be captured by the vacuum pump 31 for exhaustion.

It should be noted that, high speed electrons have a relatively smaller cross section of collision with the gas molecules which lowers ionization efficiency for gases. In the present invention, however, since an electric field for decelerating electrons is applied by the DC power supply 28 between the electron accelerating grid 22 and the cylindrical electrode 23, the electrons are gradually decelerated between the components 22, 23, the cross section with the gas molecules increases and ionization occurs effectively. Further, while it is difficult to generate discharge between the cold cathode 21 and the electron accelerating grid 22 when the gas pressure is lowered, discharge may be continued under the presence of the magnetic field created by the electromagnet 26 and pumping effect is maintained even when the gas pressure in the vessel 25 is lowered.

Further, in the case where the DC power supply 28 is removed to bring the cylindrical electrode 23 and the electron accelerating grid 22 to the same potential, those electrons which have passed the electron accelerating grid 22 by obtaining a large kinetic energy lose their speed and are reversed when they have reached the cylindrical electrode 23. They are started to be accelerated again toward the electrode accelerating grid 22, repeating collision with gas molecules to generate ions.

In this way, gas in the vacuum vessel 32 and the molecules which are diffused back or desorbed from the vacuum pump 31, which become the cause of the reduction in the degree of vacuum, are ionized and accelerated by the high vacuum device according to the present invention to be returned again to the vacuum pump 31. Thus a high degree of vacuum may be achieved. Further, if only the vacuum pump 31 is used, only those gas molecules having entered the exhaust hole are exhausted. However, since the high vacuum device of the present invention is jointly used to actively ionize and to accelerate the gas molecules to feed them into the vacuum pump 31, the discharging efficiency is improved and a high degree of vacuum is achieved.

It should be noted that, the power supply 28 may also be variable so that the potential at the cylindrical electrode 23 is adjusted to the best point for the discharging efficiency of the pump. In this way, a high degree of vacuum may be achieved.

Figure 2:
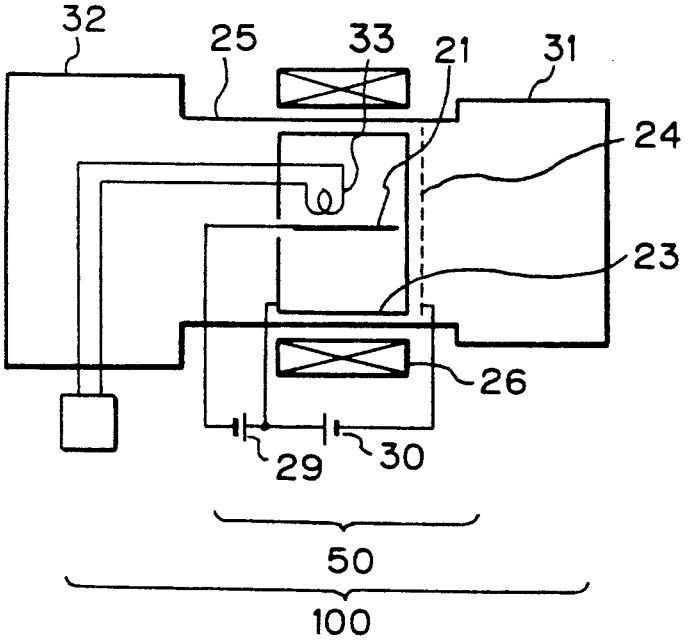
FIG. 2 is a view showing a second embodiment of the high vacuum device and the vacuum pumping unit including the high vacuum device according to the present invention.

A second embodiment of the high vacuum device and the vacuum pumping unit including the high vacuum device according to the present invention will now be described with reference to FIG. 2. In FIG. 2, those components having the same effects and functions as those components in FIG. 1 are denoted by the same reference numerals and description thereof will be omitted.

A rod-like cold cathode 21 is disposed at the center of the vessel 25, and a cylindrical electrode 23 forming the outer electrode surround the cold cathode 21. Further, an ion accelerating grid 24 is disposed so as to intersect the axis of the cylindrical electrode 23 and installed apart from the cylindrical electrode 23.

Further, an electromagnet 26 is disposed outside of the vessel 25. The electromagnet 26 is arranged to produce a DC magnetic field almost parallel to the axis of the cylindrical electrode 23.

A DC high voltage power supply 29 for discharge applies a DC high voltage between the cold cathode 21 and the cylindrical electrode 23. The ion accelerating DC power supply 30 applies a voltage between the cylindrical electrode 23 and the ion accelerating grid 24 so as to get the ion accelerating grid 24 negative.

Operation will now be described of the high vacuum device constructed as described above and of the vacuum pumping unit including the high vacuum device.

The DC high voltage power supply 29 makes a discharge between the cold cathode 21 and the cylindrical electrode 23. Electrons generated by the discharge are accelerated toward the cylindrical electrode 23. Since a magnetic field is applied by the electromagnet 26 orthogonally to the electron's movement in the space between the cold cathode 21 and the cylindrical electrode 23, the electrons move toward the cylindrical electrode 23 in circular paths within a plane perpendicular to the central axis of the cylindrical electrode 23. Under the circular movement, the electrons' path toward the cylindrical electrode 23 is greatly lengthened and they collide with a lot of gas molecules to generate a large amount of ions. The generated ions are accelerated toward the ion accelerating grid 24 and captured by the vacuum pump 31.

Figure 3:
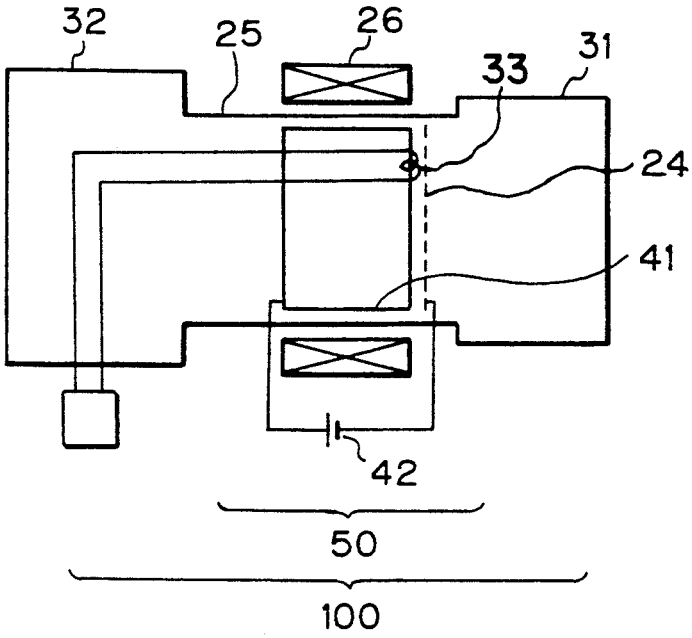
FIG. 3 is a view showing a third embodiment of the high vacuum device and the vacuum pumping unit including the high vacuum device according to the present invention.

A third embodiment of the high vacuum device and the vacuum pumping unit including the high vacuum device according to the present invention will now be described with reference to FIG. 3. In FIG. 3, those components having the same effects and functions as those components in FIG. 1 are denoted by the same reference numerals and description thereof will be omitted.

In the vessel 25, a flat plate-like grid electrode 24 is installed apart from the cylindrical electrode 41. Further, an electromagnet 26 is disposed outside of the vessel 25 in a similar arrangement as in the embodiment shown in FIG. 1.

A DC high voltage power supply 42 applies potential between the cylindrical electrode 41 and the grid electrode 24 so as to get the grid electrode 24 negative.

Operation will now be described of the high vacuum device constructed as described above and of the vacuum pumping unit including the high vacuum device. A discharge occurs between the cylindrical electrode 41 and the grid electrode 24 by the DC high voltage power supply 42 to generate a great amount of ions. The ions are accelerated toward the grid electrode 24 and pass through the grid electrode 24 to be captured by the vacuum pump 31. The electromagnet 26 has the effect of lengthening orbit of the electrons so that discharge is continued to maintain the pumping effect even when the gas pressure in the vessel 25 is lowered and the degree of vacuum increases.

Figure 4:
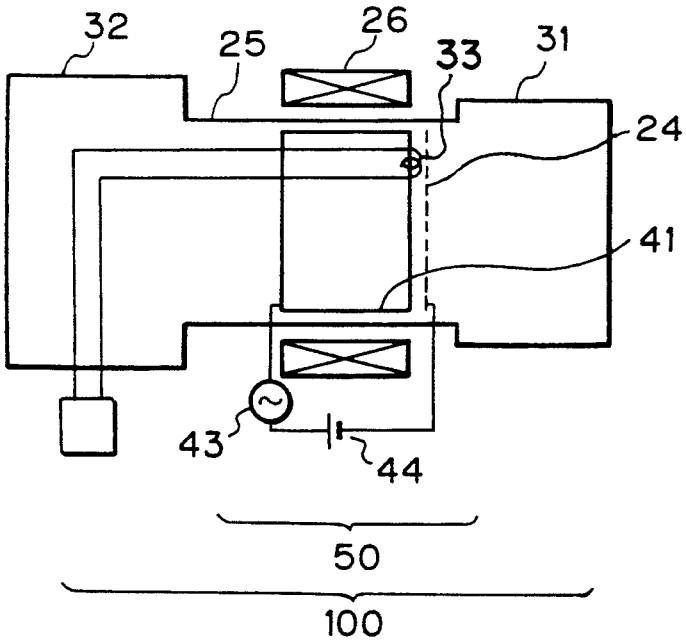
FIG. 4 is a view showing a fourth embodiment of the high vacuum device and the vacuum pumping unit including the high vacuum device according to the present invention.

A fourth embodiment of the high vacuum device and the vacuum pumping unit including the high vacuum device according to the present invention will now be described with reference to FIG. 4. In FIG. 4, those components having the same effects and functions as those components in FIG. 1 are denoted by the same reference numerals and description thereof will be omitted.

In the vessel 25, a cylindrical electrode 41 is disposed in a similar arrangement as in the embodiment of FIG. 3, and a grid electrode 24 is installed apart from the cylindrical electrode 41. A high frequency power supply 43 and a DC power supply 44 apply their output between the cylindrical electrode 41 and the grid electrode 24. The DC power supply 44 is connected so as to get the grid electrode 24 negative. The operation of the present embodiment is as follows.

A discharge occurs between the cylindrical electrode 41 and the grid electrode 24 by the high frequency power supply 43 to generate a large amount of ions. These ions are accelerated by the DC power supply 44 toward the grid electrode 24 and pass through the grid electrode 24 to be captured by the vacuum pump 31. The electromagnet 26 has the effect of lengthening the orbit of the electrons so that discharge is continued to maintain the pumping effect even when the gas pressure in the vessel 25 is lowered and the degree of vacuum increases.

Figure 5:
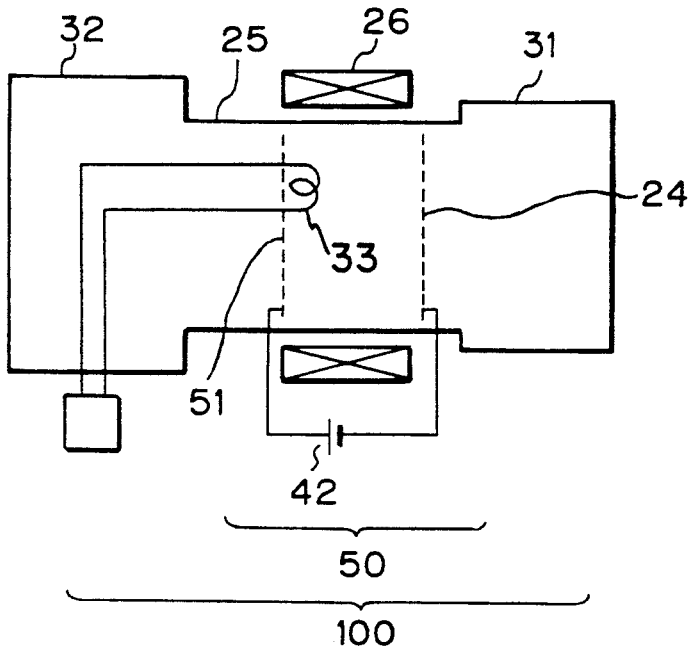
FIG. 5 is a view showing a fifth embodiment of the high vacuum device and the vacuum pumping unit including the high vacuum device according to the present invention.

FIG. 5 shows a fifth embodiment of the high vacuum device and the vacuum pumping unit including the high vacuum device according to the present invention. In this figure, those components having the same effects and functions as those components in FIG. 1 are denoted by the same reference numerals and description thereof will be omitted.

In the vessel 25, a grid electrode 51 and a grid electrode 24 are installed opposite to each other. A DC high voltage power supply 42 is connected between the two grid electrodes 51, 24 so as to get the grid electrode 24 negative. The operation of the present embodiment is as follows.

A discharge occurs between the grid electrode 51 and the grid electrode 24 by the high voltage DC power supply 42 to generate a large amount of ions. The ions are accelerated toward the grid electrode 24 and pass through the grid electrode 24 to be captured by the vacuum pump 31. The electromagnet 26 has the effect of lengthening the orbit of the electrons so that the discharge is continued to maintain the pumping effect even when the gas pressure in the vessel 25 is lowered and the degree of vacuum increases.

Figure 6:
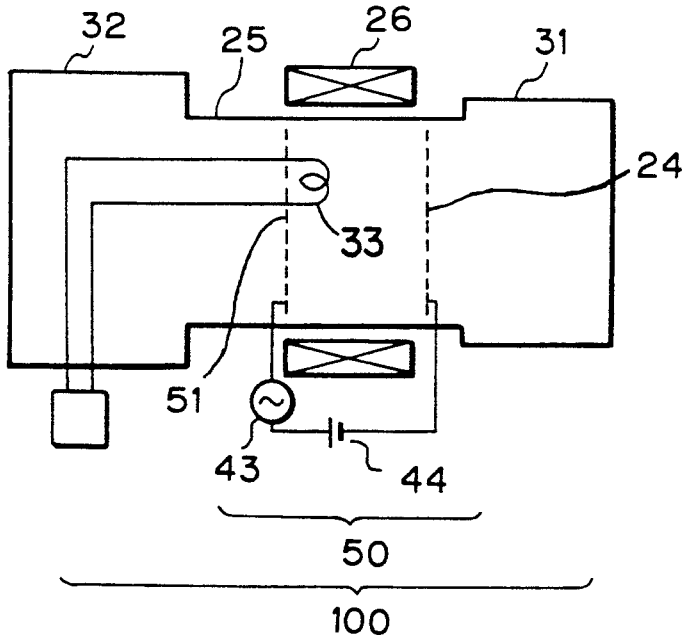
FIG. 6 is a view showing a sixth embodiment of the high vacuum device and the vacuum pumping unit including the high vacuum device according to the present invention.

FIG. 6 shows a sixth embodiment of the high vacuum device and the vacuum pumping unit including the high vacuum device according to the present invention. In this figure, those components having the same effects and functions as those components in FIG. 1 are denoted by the same reference numerals and description thereof will be omitted.

In the vessel 25, a grid electrode 51 and a grid electrode 24 are installed opposite to each other. A high frequency power supply 43 and a DC high voltage power supply 44 are connected between the two grid electrodes 51, 24. The DC power supply 44 is connected so as to get the grid electrode 24 negative. The operation of the present embodiment is as follows.

A discharge occurs between the grid electrode 51 and the grid electrode 24 by the high frequency power supply 43 to generate a large amount of ions. The ions are accelerated by the DC power supply 44 toward the grid electrode 24 and pass through the grid electrode 24 to be captured by the vacuum pump 31. The electromagnet 26 has the effect of lengthening the orbit of the electrons so that discharge is continued to maintain the pumping effect even when the gas pressure in the vessel 25 is lowered and the degree of vacuum increases.

In the embodiments shown in from FIG. 1 to FIG. 6, ions are produced by the collision between the gas molecules and the electrons generated through cold cathode discharge. As another method for gas ionization, a heat filament 33 may be disposed in the vicinity of the cold cathode 21 of the first and second embodiments (see FIG. 1, FIG. 2), or installed between the grid electrode 24 and the cylindrical electrode 41 of the third and fourth embodiments (see FIG. 3, FIG. 4) or between the grid electrode 24 and the grid electrode 51 of the fifth and sixth embodiments (see FIG. 5, FIG. 6). When the filament is heated to emit thermoelectrons, the electrons trigger discharge so as to start the high vacuum device.

Figure 7:
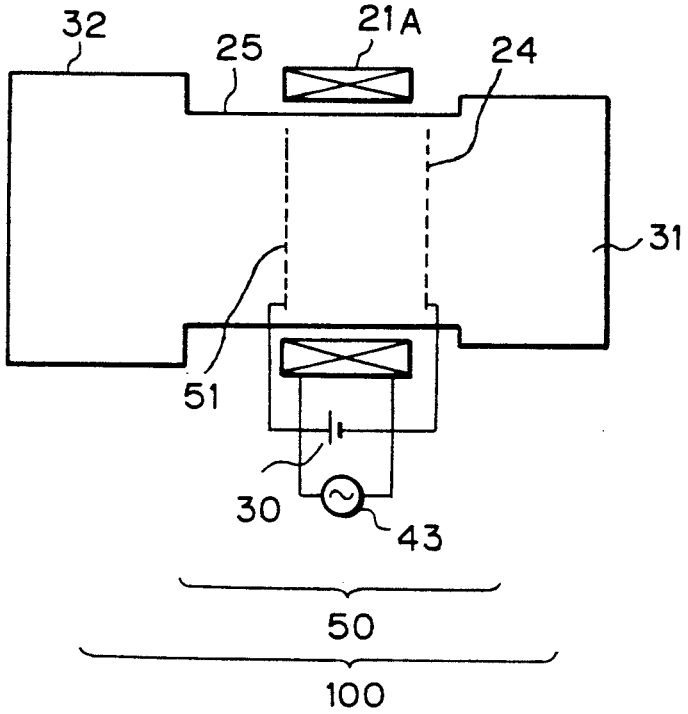
FIG. 7 is a view showing a seventh embodiment of the high vacuum device and the vacuum pumping unit including the high vacuum device according to the present invention.

FIG. 7 shows a seventh embodiment of the present invention in which numeral 50 denotes an exhaust apparatus of the present invention and numeral 100 denotes a vacuum pumping unit also of the present invention using the high vacuum device 50. Said vacuum pumping unit 100 is constituted by combining the high vacuum device 50 and a vacuum pump 31 provided on the back pressure side of the high vacuum device 50.

Said high vacuum device 50 includes a vessel 25 for connecting the vacuum pump 31 and a vacuum vessel 32 to be evacuated. The vessel 25 is cylindrical or rectangular in cross section and is made of a glass or ceramic. In the vessel 25, a flat plate-like ion collecting or attracting grid 24 and a flat plate-like grid electrode 51 are installed opposite to each other.

A DC power supply 30 is connected so as to get the ion collecting grid 24 negative with respect to the grid electrode 51. Further, a coil 21A is installed outside of the vessel 25 so as to surround the vessel 25. A high frequency power supply 43 is connected to the coil 21A.

The vacuum pump 31 may be a turbo-molecular pump, an oil pump or an ion pump.

Operation will now be described of the high vacuum apparatus constructed as described above and of a vacuum pumping unit using such high vacuum apparatus.

A high frequency current flows through the coil 21A by the high frequency power supply 43, and discharge occurs between the grid electrode 51 and the ion collecting grid 24 by the inductive coupling phenomenon which generates a large amount of ions. A pumping effect is achieved such that the ions are accelerated toward the ion collecting grid 24 by the DC power supply 30 and pass through it to be captured by the vacuum pump 31.

It should be noted that the output of the power supply 30 is transmitted to the components 24 and 51 through vacuum tight terminals provided at a portion of the vessel 25.

In this way, gas molecules in the vacuum vessel 32 are ionized and accelerated by the high vacuum device of the invention to be actively fed to the vacuum pump 31 and at the same time the molecules which are diffused back or desorbed from the vacuum pump 31. Thus a high degree of vacuum may be achieved.

Figure 8:
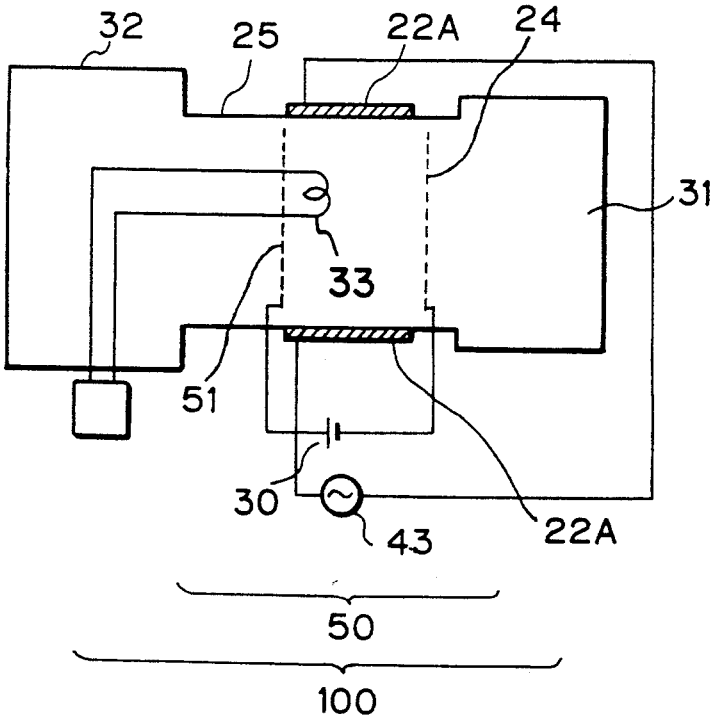
FIG. 8 is a view showing a eighth embodiment of the high vacuum device and the vacuum pumping unit including the high vacuum device according to the present invention.

A eighth embodiment of the high vacuum device and the vacuum pumping unit including the high vacuum device according to the present invention will now be described with reference to FIG. 8. In FIG. 8, those components having the same effects and functions as those components in FIG. 7 are denoted by the same reference numerals and description thereof will be omitted.

A pair of plate-like electrodes 22A are provided outside of the vessel 25 in contact with the outer wall of the vessel 25 opposite to each other. And a high frequency power supply 43 is connected to the pair of plate-like electrodes 22A. For the other portions, the construction is the same as the construction in FIG. 7. Operation of the present embodiment is as follows.

A high frequency voltage is applied to the electrodes 22A by the high frequency power supply 43. Discharge by the capacitive coupling phenomenon between the grid electrode 51 and the ion collecting grid 24 makes a large amount of ions. Thus, in a similar manner as in the case of FIG. 7, a pumping effect is achieved such that the ions are accelerated toward the ion collecting grid 24 by the DC power supply 30 and pass through it to be captured by the vacuum pump 31.

Figure 9:
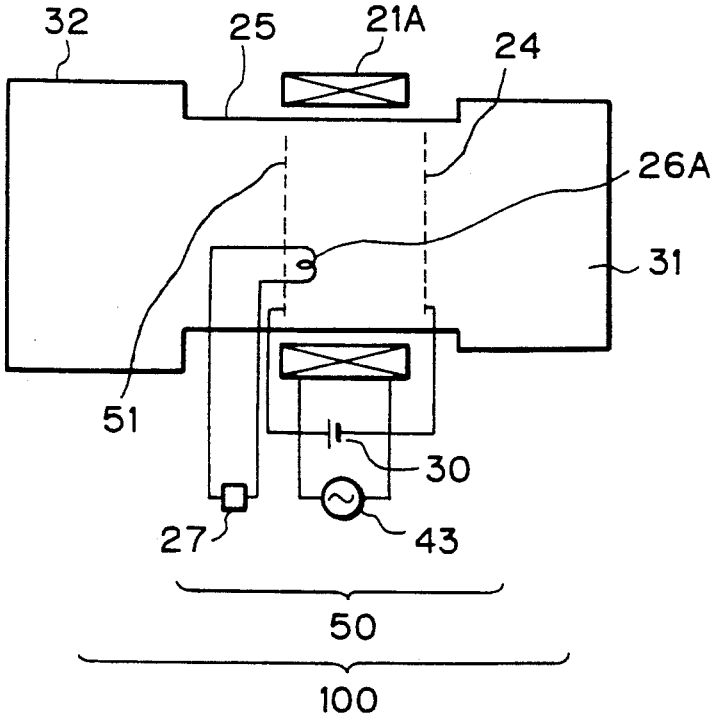
FIG. 9 is a view showing a ninth embodiment of the high vacuum device and the vacuum pumping unit including the high vacuum device according to the present invention.

FIG. 9 shows a ninth embodiment of the high vacuum device and the vacuum pumping unit including the high vacuum device according to the present invention. In this figure, those components having the same effects and functions as those components in FIG. 7 are denoted by the same reference numerals and description thereof will be omitted.

The present embodiment is constructed by adding a heat filament to the seventh embodiment (see FIG. 7). That is, a heat filament 26 is disposed in the vicinity of the grid electrode 51 and a heating power supply 27 is connected to the heat filament 26.

In the seventh and eighth embodiments (see FIG. 7, FIG. 8), ions are produced by bombardment of the electrons generated in discharge that is induced by inductive coupling of a high frequency magnetic field or capacitive coupling of a high frequency electric field. If however an attempt is made to start these high vacuum devices in the condition where the pressure is low, there occurs a problem that the discharge is difficult to be generated. To avoid this, a heat filament 26A is provided between the ion collecting grid 24 and the grid electrode 51, and is heated by a power supply 27 to emit thermoelectrons. These electrons trigger discharge.

Figure 10:
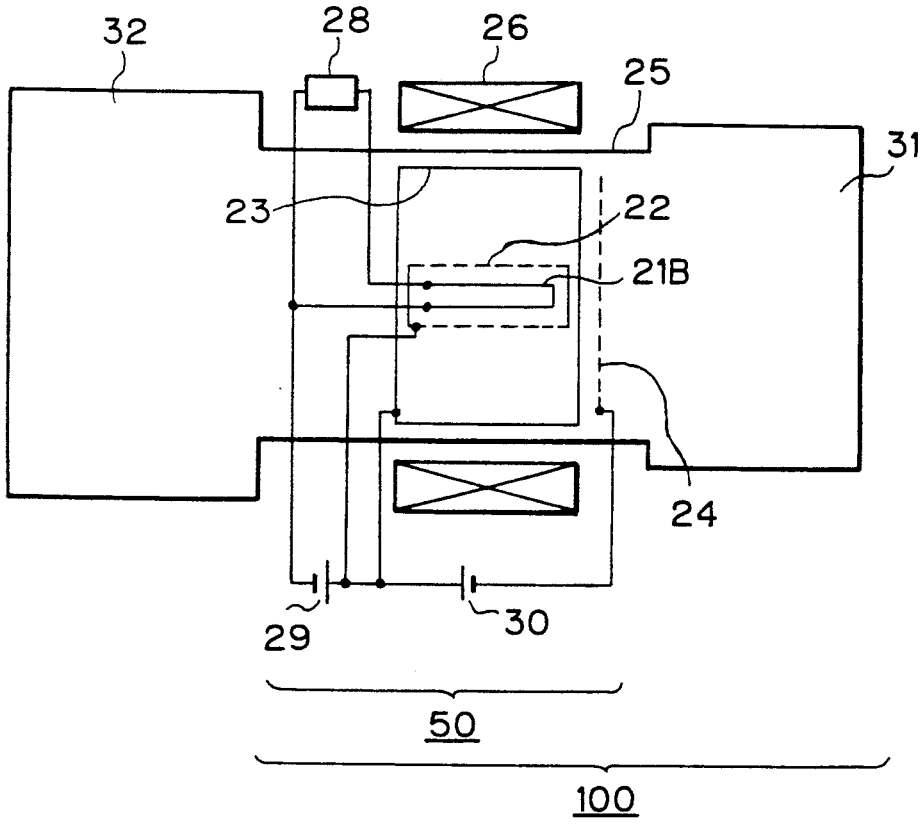
FIG. 10 is a view showing a tenth embodiment of the high vacuum device and the vacuum pumping unit including the high vacuum device according to the present invention.

In the tenth embodiment shown in FIG. 10, a reference numeral 50 denotes an exhaust apparatus or an exhaust apparatus according to the present invention, and 100 denotes a vacuum pumping unit or vacuum pumping unit, the vacuum pumping 100 comprising a combination of the exhaust apparatus 50 with an arbitrary vacuum pump 31 provided on a back pressure side of the exhaust apparatus 50.

The exhaust apparatus 50 comprises a hairpin shaped thermal electron emission filament 21B as a thermal electron emission source, a cylindrical electron accelerating grid 22, a cylindrical outer electrode 23, an ion accelerating flat grid 24, a vessel 25, an electromagnet 26, a power supply 28 for heating the filament 21B, an electron accelerating DC power supply 29, and an ion accelerating DC power supply 30, and the exhaust apparatus is interposed between a vacuum vessel 32 to be evacuated and the vacuum pump 31 which operates as an auxiliary pump.

The thermal electron emission filament 21B, the electron accelerating grid 22, the outer electrode 23, and the ion accelerating grid 24 are each disposed within the vessel 25.

The filament 21B is disposed nearly at the center of the vessel 25, and is also disposed along a longitudinal axis of the vessel.

The electron accelerating grid 22 is disposed surrounding the filament 21B, and the outer electrode 23 is disposed surrounding the electron accelerating grid 22.

Then, the ion accelerating grid 24 intersects an axis of the outer electrode 23 perpendicularly and is disposed on the vacuum pump 31 side apart somewhat from the outer electrode 23.

The electromagnet 26, the power supply 28, the electron accelerating DC power supply 29, and the ion accelerating DC power supply 30 are disposed out of the vessel 25, and the electromagnet 26 disposed along a peripheral portion of the vessel 25 generates a DC magnetic field almost parallel with the axis of the outer electrode 23 in the vessel 25.

The DC power supply 29 is connected between the filament 21B, the electron accelerating grid 22 and the outer electrode 23, and applies a voltage so as to get the filament 21B in negative potential.

The ion accelerating DC power supply 30 is connected between the electron accelerating grid 22, the outer electrode 23 and the ion accelerating grid 24, which applied a voltage so as to get the outer electrode 23 in positive potential.

Then a current and a voltage from the power supplies 28, 29, 30 are applied to the above-mentioned element 21B, 22, 23 and 24 through current leading-in terminals (not indicated) provided on a part of the vessel 25.

When the filament 21B is heated by the power supply 28, the filament 21B emits thermal electrons. The emitted electrons are accelerated toward the electron accelerating grid 22, and obtain a sufficient energy. Then they pass through the electron accelerating grid 22. A magnetic field which orthogonally crosses the direction of the electrons movement is applied by the electromagnet 26 within a space between the electron accelerating grid 22 and the outer electrode 23, and thus the electrons move in a circular motion within the plane perpendicular to an axis of the outer electrode 23 while moving toward the outer electrode 23. Due to the circular motion of the electrons, a path of the electrons to reach the outer electrode 23 becomes longer, and thus the electrons easily come to collide with a lot of gas molecules and produce a large quantity of ions. The produced ions are accelerated toward the ion accelerating grid 24, and exhausted through the pump 31.

On the other hand, the gas molecules flowing back or desorbed from the vacuum pump 31 toward a high vacuum side are ionized and accelerated likewise in the manner stated above by the exhaust apparatus 50 and returned to the vacuum pump 31, therefore a high vacuum level is attained in the vacuum vessel.

In the prior art, when an evacuation is carried out only by the vacuum pump 31, only gas molecules coming into the exhaust pipe are exhausted. However, since the gas molecules are ionized and accelerated for exhaust by the above-mentioned operation of the invention, an exhaust efficiency is increased and a high vacuum level is obtained.

Figure 11:
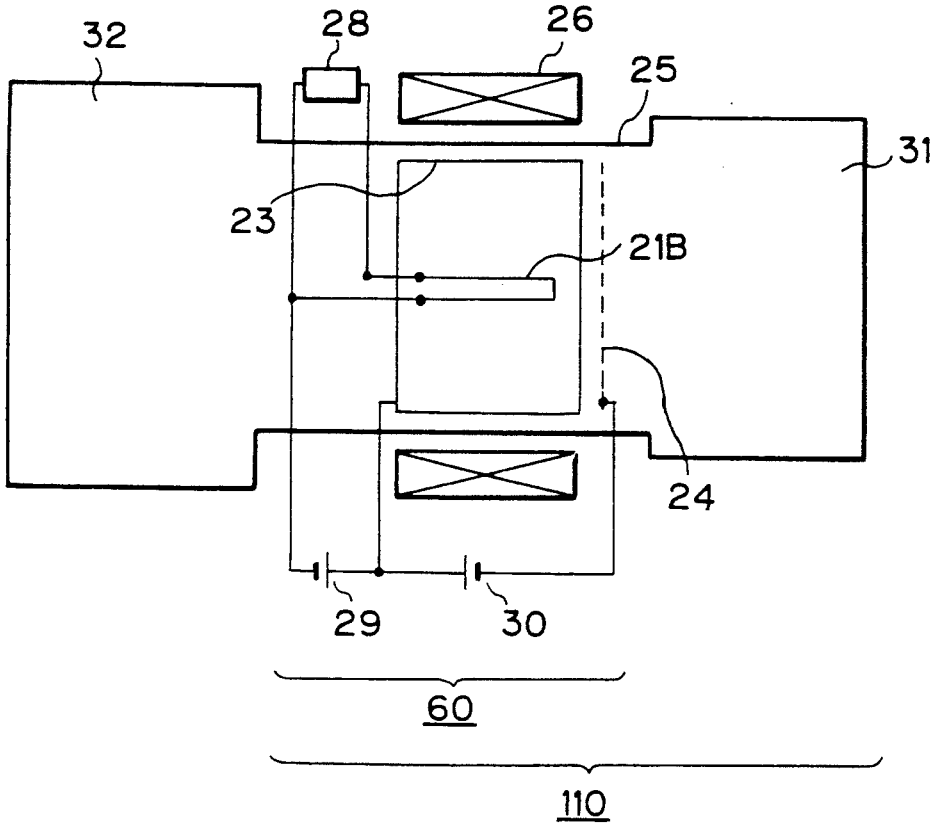
FIG. 11 is a view showing a eleventh embodiment of the high vacuum device and the vacuum pumping unit including the high vacuum device according to the present invention.
Figure 12:
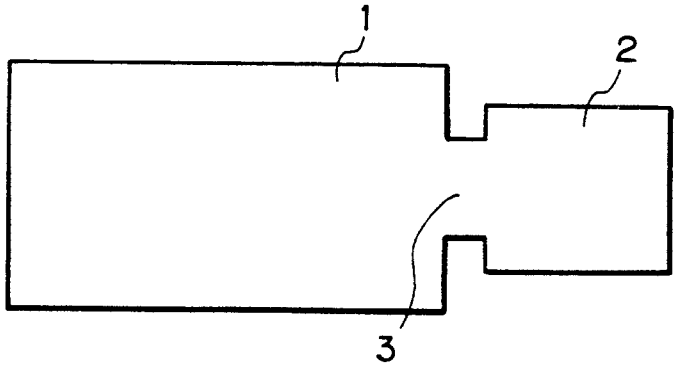
Fig. 12 PRIOR ART
FIG. 12 is a view showing a conventional evacuating method.

FIG. 11 represents an exhaust apparatus and a vacuum pumping unit according to the eleventh embodiment of the present invention.

The embodiment comprises a structure almost same as the embodiment shown in FIG. 10. As the same reference numbers represent the same constituents and operation in FIG. 10 and FIG. 11, repetitious descriptions will be omitted here.

In FIG. 11, a reference number 60 denotes an exhaust apparatus, 110 denotes a vacuum pumping unit which operates on the exhaust apparatus 60. The vacuum pumping unit 110 consists of the exhaust apparatus 60 and the arbitrary vacuum pump 31 provided on a back pressure side of the exhaust apparatus 60.

In the exhaust apparatus 60 of this embodiment, the electron accelerating grid 22 in FIG. 10 is omitted. That is, the exhaust apparatus 60 has only the hairpin shaped thermal electron emission filament 21B as a thermal electron emission source and the outer electrode 23 surrounding the filament 21B concentrically disposed within the vessel 25.

In FIG. 11, thermal electrons emitted from the heated filament 21B are attracted toward the outer electrode 23, and make a circular orbit under the magnetic field generated by the electromagnet 26. As the electrons run on a long path because of the circular orbit until the reach of the electrode 23, they collide with a lot of gas molecules to produce a large quantity of ions. The produced ions are accelerated toward the ion accelerating grid 24 and are exhausted by the pump 31. As a result, the gas molecules are exhausted by the vacuum pump 31 operating as an auxiliary exhaust means.

Thus, the present embodiment has a difference partly in construction and operation from the embodiment of FIG. 10, but, an exhaust effect is same.

As is apparent from the foregoing description, according to an exhaust apparatus of the present invention, a high vacuum may be achieved in a vacuum vessel by ionizing and accelerating the gas molecules within the vacuum vessel for discharge. Further, according to a vacuum pumping unit of the present invention, those gas molecules diffused back or desorbed from the vacuum pump may be ionized and accelerated to be returned to the vacuum pump. At the same time the gas molecules in the vacuum vessel may be ionized and accelerated so that they are actively fed into the vacuum pump. Thus the discharge efficiency may be improved to achieve a high degree of vacuum in the vacuum vessel. Furthermore, in the case of using an oil diffusion pump as the vacuum pump, there is no need for jointly using a cold trap by means of liquid nitrogen. A reduction in costs may thus be achieved and, because of the fact that problems associated with supplying liquid nitrogen are eliminated, prolonged operation will be possible.

What is claimed is:

1. An exhaust apparatus comprising: a cathode; an electron accelerating grid surrounding the cathode; an outer electrode disposed radially outward of and surrounding the electron accelerating grid; an ion accelerating grid intersecting the longitudinal axis of the outer electrode and installed apart from the outer electrode; a vessel for accommodating the grids and the electrodes; a magnet disposed outside of the vessel for generating a magnetic field almost parallel to the longitudinal axis of said outer electrode; a high voltage power supply for applying a high voltage between said cathode and said electron accelerating grid; a DC power supply for applying a voltage between said electron accelerating grid and said outer electrode; and a DC power supply for applying a voltage between said outer electrode and said ion accelerating grid so as to get said outer electrode positive.

2. An exhaust apparatus of claim 1, wherein the DC power supply for applying a voltage between said electron accelerating grid and said outer electrode generates a variable output.

3. An exhaust apparatus of claim 1, wherein the DC power supply connected between said electron accelerating grid and said outer electrode is removed to equalize potentials at said electron accelerating grid and said outer electrode.

4. An exhaust apparatus comprising: a cold cathode; an electron accelerating grid surrounding the cold cathode; an outer electrode disposed radially outward of and surrounding the electron accelerating grid; an ion accelerating grid intersecting the longitudinal axis of the outer electrode and installed apart from the outer electrode; a vessel for accommodating the grids and the electrodes; a magnet disposed outside of the vessel for generating a magnetic field almost parallel to the longitudinal axis of said outer electrode; a high voltage power supply for applying a high voltage between said cold cathode and said electron accelerating grid; a DC power supply for applying a voltage between said electron accelerating grid and said outer electrode; and a DC power supply for applying a voltage between said outer electrode and said ion accelerating grid so as to get said outer electrode positive.

5. An exhaust apparatus of claim 4, wherein a heat filament for emitting thermoelectrons is disposed near the cold electrode.

6. An exhaust apparatus of claim 4, wherein the DC power supply connected between said electron accelerating grid and said outer electrode is removed to equalize potentials at said electron accelerating grid and said outer electrode.

7. An exhaust apparatus of claim 4, wherein the DC power supply for applying a voltage between said electron accelerating grid and said outer electrode generates a variable output.

8. An exhaust apparatus of claim 4, wherein the cold cathode is a rod-like cold cathode.

9. An exhaust apparatus of claim 4, wherein the cold cathode is disposed at the center of the vessel.

10. An exhaust apparatus of claim 4, wherein the electron accelerating grid surrounds the cold cathode.

11. An exhaust apparatus of claim 4, wherein the outer electrode is a cylindrical electrode.

12. An exhaust apparatus of claim 4, wherein the outer electrode surrounds the electron accelerating grid.

13. An exhaust apparatus of claim 4, wherein the ion accelerating grid is disposed so that it orthogonally crosses the longitudinal axis of the outer electrode.

14. An exhaust apparatus of claim 4, wherein the ion accelerating grid is a plate-like grid.

15. An exhaust apparatus of clam 4, wherein the vessel forms a structure which serves as an exhaust hole of a vessel to be evacuated by the high vacuum device or a structure which is in communication with the exhaust hole of the vacuum vessel.

16. A vacuum pumping unit comprising: an optionally selected vacuum pump; and an exhaust apparatus of any one of claims 1 to 5 provided between the vacuum pump and a vessel to be evacuated.

17. An exhaust apparatus comprising: a cold cathode; an outer electrode disposed radially outward of and surrounding the cold cathode; an ion accelerating grid crossing the longitudinal axis of the outer electrode and installed apart from the outer electrode; a vessel for accommodating the grid and the electrodes; a magnet disposed outside of the vessel for generating a magnetic field almost parallel to the longitudinal axis of said outer electrode; a high voltage power supply connected between said cold cathode and said outer electrode; and a DC power supply connected between said outer electrode and said ion accelerating grid so as to get said outer electrode positive.

18. An exhaust apparatus of claim 17, wherein a heat filament for emitting thermoelectrons is disposed near the cold electrode.

19. An exhaust apparatus of claim 17, wherein the cold cathode is a rod-like cold cathode.

20. An exhaust apparatus of claim 17, wherein the cold cathode is disposed at the center of the vessel.

21. An exhaust apparatus of claim 17, wherein the outer electrode is a cylindrical electrode.

22. An exhaust apparatus of claim 17, wherein the outer electrode surrounds the cold cathode.

23. An exhaust apparatus of claim 17, wherein the ion accelerating grid is disposed so that it orthogonally crosses the longitudinal axis of the outer electrode.

24. An exhaust apparatus of claim 17, wherein the ion accelerating grid is a plate-like grid.

25. An exhaust apparatus of claim 17, wherein the vessel forms a structure which serves as an exhaust hole of a vessel to be evacuated by the high vacuum device or a structure which is in communication with the exhaust hole of the vacuum vessel.

26. A vacuum pumping unit comprising: an optionally selected vacuum pump; and an exhaust apparatus of any one of claims 17 to 18 provided between the vacuum pump and a vessel to be evacuated.

* * * * *